United States Patent [19]

Ritchey et al.

[11] Patent Number: 5,041,050

[45] Date of Patent: Aug. 20, 1991

[54] DOLL HEAD AND DETACHABLE WIG

[76] Inventors: Mary F. Ritchey, 435 Lincolnway Dr., York, Pa. 17404; Joyce E. Elberson, Box 307, c/o Jacob & Betty Walters, Saxton, Pa. 16678

[21] Appl. No.: 628,416

[22] Filed: Dec. 17, 1990

[51] Int. Cl.[5] ..... A63H 3/44; A63H 3/36

[52] U.S. Cl. ..... 446/394; 446/391

[58] Field of Search ..... 446/394, 391, 372, 369, 446/319, 321, 337, 385

[56] References Cited

FOREIGN PATENT DOCUMENTS

| | | | |
|---|---|---|---|
| 214342 | 10/1909 | Fed. Rep. of Germany | 446/394 |
| 1195422 | 3/1959 | France | 446/394 |
| 2559676 | 8/1985 | France | 446/321 |
| 555556 | 4/1958 | United Kingdom | 446/394 |
| 997266 | 7/1965 | United Kingdom | 446/394 |

*Primary Examiner*—D. Neal Muir

*Attorney, Agent, or Firm*—C. Hercus Just

[57] ABSTRACT

A doll head and wig combination in which the head has a groove in the rear surface thereof extending between the ears and the wig has a rim of which a limited extent thereof is elastic and is tightly received in the groove in the head and the forward portion of the wig extends across the forehead above the eyes, and patches or strips of adhesive material are mounted on the inside of the forward portion of the wig or upon the upper forehead for separable attachment of the wig to the forehead of the doll head or, alternatively, pairs of detachable patches of "Velcro" are mounted respectively on the forehead of the doll in spaced relationship and on corresponding locations on the interior of the wig, both of which arrangements permit limited adjustable positioning of the forward edge of the wig relative to the forehead of the doll incident to maintaining the elastic in tight relationship in the groove in the rear portion of the head.

3 Claims, 1 Drawing Sheet

DOLL HEAD AND DETACHABLE WIG

BACKGROUND OF THE INVENTION

For many years it has been a practice to provide wigs on toy dolls. For a long period of time, it was customary to permanently affix the wigs to the head of the doll with glue or cement but, in more recent years, dolls have been manufactured with detachable wigs, especially to provide interchangeable different types of hair arrangements on the wigs or to use wigs of different colors interchangeably. The present invention pertains to a novel arrangement for detachably connecting a wig to a head of a doll and, if desired, the wigs may be of different colors or of different hair styles.

Pertinent prior patents directed to various types of doll heads and wigs and attaching means are illustrated in the following U.S. patents:

| | | | |
|---|---|---|---|
| Ryan | 3,225,489 | Strongin et al | 4,070,790 |
| Terzian | 3,765,123 | Dirks | 4,874,345 |
| Whetzel | 3,889,414 | (British) | 809,054 |
| Dunn | 3,903,640 | | |

In general, in this prior art, various means are used to attach wigs to doll heads and some of them are more complex than others. The present invention comprises an improvement over those shown in said prior art.

SUMMARY OF THE INVENTION

It is the general purpose of the present invention to provide a wig with very simple attaching means by which it is secured to the skull or head of the doll and a limited amount of adjustability is permitted due to the nature of the detachable means by which the wig is secured to the head. Primarily, a wig comprising a generally hemispherical and preferably flexible base member to which real or artificial hair is attached and said base member is provided with a length of elastic means secured to substantially one-half of the rim of the wig which is opposite the forward portion thereof. The forward portion of the wig is attached to the forehead of the doll by readily detachable means, such as spaced patches or a strip of adhesive affixed to the interior of the forward portion of the wig or to the forehead for detachable attachment of the forward portion of the wig to the forehead portion of the head. As an alternative, pairs of relatively small patches of detachable connecting means, sold under the tradename "Velcro", are utilized and affixed respectively to the inner surface of the forward portion of the wig and the exterior surface of the forehead, above the eyes of the doll head, are utilized to adjustably and easily detachably connect the wig to the head. For utilizing either of these alternatives, the doll head is provided with a semi-circular groove on the rear portion of the head between the ears and preferably tightly receives the elastic rim portion of the wig.

Other objects and advantages of the present invention are set forth in the following specification and are illustrated in the accompanying drawings, wherein.

DETAILED DESCRIPTION OF THE PREFERRED EMBODIMENT OF THE INVENTION

Figure 1:
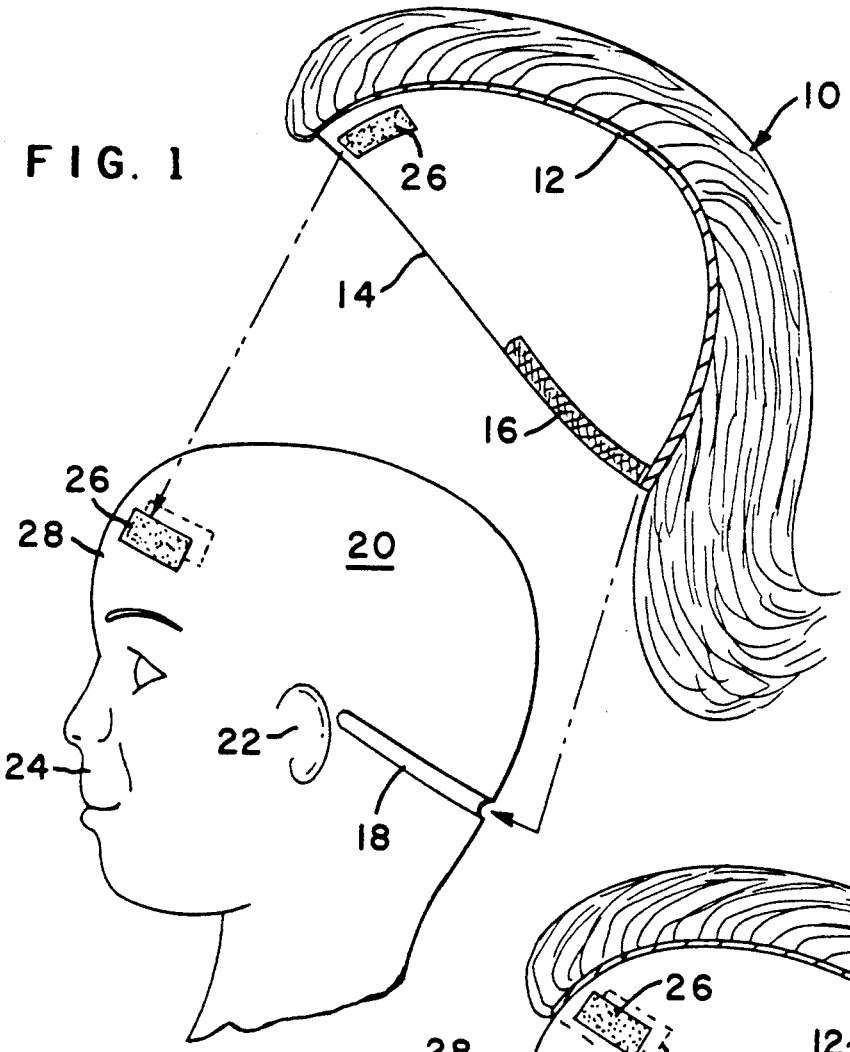
FIG. 1 is an expanded view showing a side elevation of a doll head and a vertical half section of a wig which is to be attached to the upper portion of the head.
Figure 2:
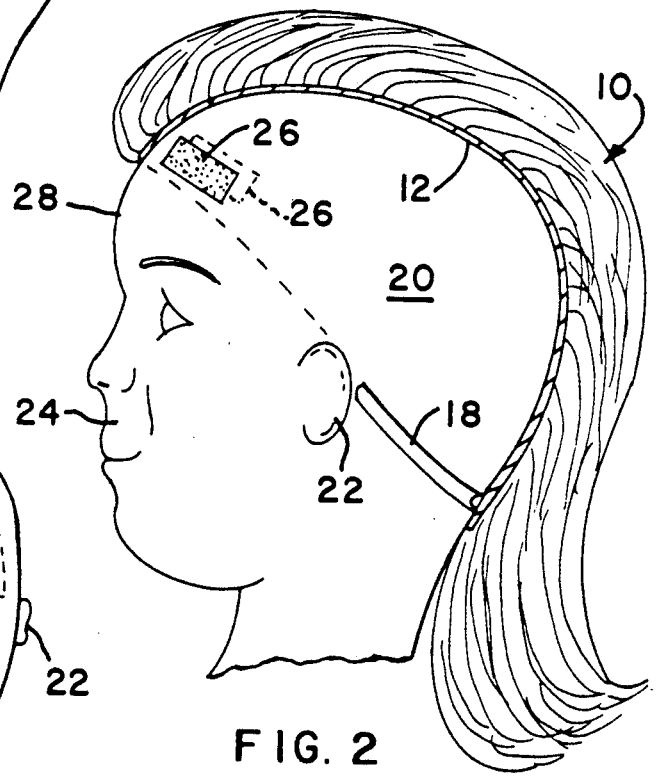
FIG. 2 is a view similar to FIG. 1, but showing a vertical half section of the wig in operative position upon the head of the doll.
Figure 3:
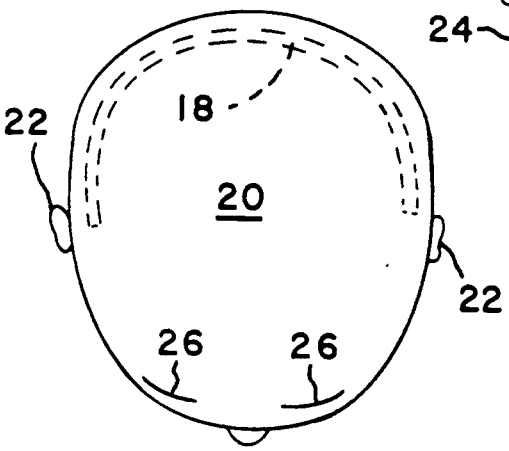
FIG. 3 is a top plan view of the head of the doll per se on substantially the same scale as the preceding figures.

Referring to the figures, it will be seen that the wig 10 is illustrated in FIGS. 1 and 2 as a vertical half section of the complete wig. The wig comprises a base member 12, which is shown in section and comprises any suitable conventional, preferably flexible, fabric or equivalent material to which all of the strands of hair, either natural or artificial, are connected in conventional manner. The rim 14 of the wig is more or less circular and approximately the rear half of the rim 14 has an elastic bead 16 affixed thereto which is tightly received in a semi-circular groove 18 that is fixedly molded into the head 20 when formed, and extends substantially between the ears 22 on the head 20.

The head or skull may be made from any suitable material, such as plastic or otherwise, and is rigid or semi-soft in nature so as to maintain a desired shape. The face portion 24 constitutes the front of the head, while the groove 18 is considered to be in the rearward portion of the head or skull.

To attach the forward portion of the wig 10 and especially the forward portion of the base member 12 to the head or skull, transversely spaced pairs of detachable patches 26 of material sold under the tradename "Velcro" are attached permanently, respectively, to the inner forward area of the inner surface of the wig 10 and the exterior of the forehead 28 of the head or skull 20.

As an alternative to the above-described separable means to attach the forward portion of the wig to the upper portion of the forehead, either transversely spaced patches or a strip of moderate length of adhesive coated tape, such as sold under the tradename "Scotch" tape or the like, are cemented or otherwise affixed, selectively, either to the interior of the forward portion of the wig or to the forehead 30 of the doll head 20. Such releasable securing means are adequate to secure the forward portion of the wig detachably to the head of the doll in conjunction with the function of the elastic bead 16 and groove 18.

It will be seen readily from the foregoing that the wig 10 may be quickly and easily attached to the head or skull 20, for example, by first disposing the elastic bead 16 within the groove 18 of the head or skull and then pull the forward portion of the wig downwardly upon the upper portion of the forehead 28 of the head until the patches 26 are in engagement with each other, if of if of hook-loop fastening means, such as sold under the tradename "Velcro", and then are brought into close attachment with each other to removably but relatively tightly secure the wig to the head or skull.

If the patches 26 are adhesive in nature, such as "Scotch" tape, and are affixed, selectively, either to the interior of the forward portion of the wig or the exterior of the upper portion of the forehead, it can be seen that the forward portion of the wig is detachably affixed to the head of the doll and, in conjunction with the elastic bead 16 and groove 18, will maintain the wig on the head in desired position.

Due to the reasonable area of the patches 26, whether of "Velcro" or adhesive, it is possible to adjust the forward portion of the wig with respect to the forehead 28 and thereby provide a very close fit of the base member 12 of the wig to the exterior surface of the head or skull 20 over which the base member 12 is closely adhered by the attaching means described above.

From the foregoing, ti will be seen that the present invention provides a relatively simple, yet highly effective detachable connecting means between a doll head and a wig to be attached thereto. The connecting means is permanently in place on both the wig and head or skull and such arrangement provides for a plurality of different colors or different types of wigs to be commonly attached to the head or skull.

The foregoing description illustrates the preferred embodiment of the invention. However, concepts employed may, based upon such description, be employed in other embodiments without departing from the scope of the invention. Accordingly, the following claims are intended to protect the invention broadly, as well as in the specific forms shown herein.

We claim:

1. A doll head and wig arrangement comprising in combination, a. a relatively rigid doll head skull having conventional eyes and ears, a front and a rear portion, and also having a groove of limited length located around the rear portion of the skull opposite the face and extending between the ears, b. said wig being arranged to cover the front portion of the skull of the head above the ears, said wig having a rear portion and also having a semi-circular rim adapted to extend around a limited portion of the rear portion of the skull between the ears, c. said portion of the rim extending around the rear portion of the skull being elastic and adapted to be received tightly in said groove, and d. releasable securing means operable between a forward portion of the wig and an upper portion of the front portion of the doll head to adjustably and detachably secure the wig operably and detachably to said doll head and in a manner to permit said forward portion of the wig to be attached to the head adjustably for tightening the reception of said elastic rim of the wig to be disposed tightly within said groove in the head while the elastic portion of the rim secures the rear portion of the wig tightly within said groove regardless of the adjusted position of the forward portion of the wig on the skull, whereby the releasable securing means allows a user to place the wig in a variety of positions relative to the front portion of the skull.

2. The combination according to claim 1 in which said releasable securing means comprise a pair of transversely spaced limited areas of releasable fastening means secured to the interior of the forward portion of said wig and also releasably attachable directly to the forehead of the skull of the head above the eyes.

3. The combination according to claim 1 in which said releasable securing means comprises substantially matched pairs of patches of hook-loop fastening means permanently secured respectively to the interior surface of the forward portion of said wig and the forehead surface of said head above the eyes in transversely spaced relationship to each other.

* * * * *